US006247694B1

(12) United States Patent
Nonnemacher et al.

(10) Patent No.: US 6,247,694 B1
(45) Date of Patent: Jun. 19, 2001

(54) AUTOMATED BINDERY LOG EXTENSION

(75) Inventors: Daniel George Nonnemacher, Lancaster; Chad Roy Hoffman, Middletown, both of PA (US)

(73) Assignee: R. R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 09/466,008

(22) Filed: Dec. 17, 1999

(51) Int. Cl.[7] ..... B65H 3/62

(52) U.S. Cl. ..... 271/146; 270/52.18; 414/795.8; 271/157; 271/162

(58) Field of Search ..... 270/52.18; 414/795.8; 271/146, 149, 150, 157, 158, 159, 162

(56) References Cited

U.S. PATENT DOCUMENTS

| | | | | |
|---|---|---|---|---|
| 2,172,685 | | 9/1939 | Thompson . | |
| 2,498,740 | | 2/1950 | Miller . | |
| 2,838,185 | | 6/1958 | Horstkotte . | |
| 2,993,609 | | 7/1961 | Enterline et al. . | |
| 3,017,041 | | 1/1962 | Hawkes et al. . | |
| 3,521,763 | * | 7/1970 | Heide et al. | 414/795.8 |
| 3,656,743 | | 4/1972 | Ruud . | |
| 3,690,650 | | 9/1972 | Maier, Jr. et al. . | |
| 3,744,649 | | 7/1973 | Ward, Jr. . | |
| 3,854,713 | | 12/1974 | Kohda . | |
| 4,311,430 | | 1/1982 | Frederick et al. . | |
| 4,526,501 | | 7/1985 | Blumle . | |
| 4,588,180 | * | 5/1986 | Ballestrazzi et al. | 271/150 |
| 4,613,268 | | 9/1986 | Capdeboscq et al. . | |
| 4,623,292 | | 11/1986 | Suzuki et al. . | |
| 4,966,521 | | 10/1990 | Frye et al. . | |
| 4,981,292 | | 1/1991 | Cosgrove . | |
| 5,096,368 | | 3/1992 | Butterfield . | |
| 5,114,129 | | 5/1992 | Chang et al. . | |
| 5,213,321 | | 5/1993 | Stobb . | |
| 5,295,309 | | 3/1994 | Kozlowski et al. . | |
| 5,326,088 | | 7/1994 | Newsome . | |
| 5,451,040 | | 9/1995 | Crabtree . | |
| 5,634,634 | | 6/1997 | Dobbertin et al. . | |
| 5,788,459 | | 8/1998 | Neumann et al. . | |
| 5,791,643 | | 8/1998 | Bumgardner et al. . | |
| 6,017,029 | * | 1/2000 | Bates et al. | 271/150 |
| 6,050,771 | * | 4/2000 | Dykstra | 414/798.8 |

* cited by examiner

*Primary Examiner*—H. Grant Skaggs
(74) *Attorney, Agent, or Firm*—Fitch, Even, Tabin & Flannery

(57) ABSTRACT

This invention concentrates on relieving the ergonomic strain on a bindery line operator by always loading at an ergonomically correct height for minimum wrist strain and also performing the "jogging," which is normally done by the operator prior to placing a stack onto the pocket feeder. The signatures are placed onto a lift at the same height because the signature stack support is being lowered automatically until the pivoted conveyor is full. Then, the entire log is pivoted upwardly and advanced to meet the rear of the previously loaded log. The log is advanced through a series of air blasts to aerate the signatures, a vibrating table to align the backbones, and a set of oscillating guides to align the signatures head to foot to eliminate the manual jogging of signatures and thereby repetitive movement of the operator's wrist to do the jogging.

32 Claims, 8 Drawing Sheets

AUTOMATED BINDERY LOG EXTENSION

FIELD OF THE INVENTION

The present invention is generally directed to a method and apparatus for building a log of signatures or inserts and feeding them to graphic arts equipment such as a bindery line, a refolder or a trimmer.

BACKGROUND OF THE INVENTION

In recent years, many varied customer needs require rapid handling of printed products consisting of signatures which are gathered for binding, trimmed, bundled for minimal shipping costs, and shipped. In a binding line, a typical operation utilizes a multiple of inserter pockets, each of which receives signatures serially from a signature supply means, opens each signature, and drops the signatures to successively straddle a gathering chain which runs in front of the inserter pockets and carries the complete collection of gathered signatures to a location for further handling to complete the binding process. Moreover, because of the need for highly efficient plant operations, there has been a constant effort to increase the speed at which machines operate which has required the development of new techniques for handling the signatures at all stages of the binding process.

In addition to high speed operation, it will be appreciated that any apparatus necessarily has to be compatible with the limit on the space that is available in a binding line facility. In development of the present invention, it was established as a goal for the signature feeding apparatus to address the concerns in terms of ergonomic problems, such as carpal tunnel syndrome and the like.

Currently, a bindery operator retrieves a small stack of signatures, such as three to four inch pile, and carries the pile to the table surface at the pocket feeder. The signature pile is compressed and gripped between the fingers and thumb, and then it is turned 90° for placement on the signature backbone. The operator aligns the signatures in the small pile, fans them, and jogs them, creating a uniform series of signatures. The signatures are again compressed between the fingers and thumb and are then placed with their backbones down into the bindery feed pocket. Some strains to the operator that may occur in such loading activities include possible wrist strain when rotating the signatures, possible arm strain when lifting the pile of signatures to the table height, possible finger and thumb strain when gripping and compressing the signatures, possible wrist and arm strain when fanning the signatures, and walking fatigue in moving between a pallet having the signatures and the bindery pocket machine.

The assignee of this invention has been addressing the problems caused by repetitive motion in current bindery and printing tasks performed manually by operators, as can be seen from a review of its U.S. Pat. No. 5,114,129 of Chang, et al. and also U.S. Pat. No. 5,451,040 of Crabtree, and U.S. Pat. No. 5,791,643 of Bumgardner, et al. It was established in the previous patents as a goal for the signature feeding apparatus to primarily address concerns in terms of ergonomic problems, such as carpal tunnel syndrome and the like; but it was also found in solving this problem, that it was possible to increase the capacity receiving stacked signatures for feeding to the binding line within the same or a similar amount of floor space, while operating at high speed and accepting signatures in a variety of ways. The present invention is aimed mainly at the ergonomic aspects, increasing production efficiency. Also, it is preferable that the device be portable to be moved between different bindery hoppers. Alignment, jogging and aerating by bindery personnel all need to be eliminated in order to prevent the strains caused by the repetitive motions that these tasks require. The present invention addresses the needs of being able to feed signatures at high speeds to graphic arts equipment including folders, trimmers, binding lines, etc., while maintaining an ergonomically safe process and providing portability.

The present invention is described herein in connection with feeding financial stock or signatures which have frictional surfaces that renders them difficult to shingle into a consistent stream in a contrast to the usual catalogue or magazine stock that shingles easily into a consistent stream. Hence, the financial stock signatures described herein are printed as closed head signatures that are fed as an entire "log" of signatures. The present invention will be described hereinafter with respect to the formation of logs of financial signatures and feeding them into a pocket of a bindery line pocket feeder; but the present invention is not limited to this described and illustrated embodiment of the invention.

SUMMARY OF THE INVENTION

In accordance with the present invention, there is provided a new and improved ergonomical apparatus and method for building a log of signatures and loading them into a piece of graphic arts equipment such as a stitcher pocket of a binding line. This is achieved by the operator building a log of signatures in a load magazine by placing small piles of signatures on the top of a log or stack at a predetermined, adjustable height, automatically raising and turning the built log into a horizontal position, advancing the log toward the pocket; and automatically aerating, jogging and aligning the signatures head-to-foot. Preferably, as each pile of signatures is transferred by the operator from the pallet to the load magazine, the signature log piles in the load magazine is automatically lowered by the height of the pile. The preferred apparatus eliminates the rotating of the signatures through 90° by the operator and the rotating motions of the wrist heretofore doing this rotation. Also, the automatic fanning and jogging eliminate possible wrist and arm strain to the operator when accomplished by equipment, rather than by the operator.

In the preferred embodiment of the invention, the operator loads signatures into a load or log-forming assembly, which has an automatic lowering support for the vertical piles of signatures being loaded on the support to keep the top of the vertical pile at the preselected loading height for the operator. After the log is built, the load assembly is transferred to a transfer assembly, which functions to raise and to align the signature log; and to transfer the log into the jogging and aligning assembly for automatic jogging and aligning of the signatures in the log. When the transfer assembly has advanced the log into the aligning and jogging assembly, the transfer assembly returns to its load position and is ready for reloading. The entire log is advanced within the jogging assembly to meet the rear of the previously-loaded log now in the graphic arts machine. Preferably, the advancing log of signatures is automatically aerated by air nozzles, vibrated on a surface to align the backbone of the signatures and aligned head-to-foot by oscillating side guides. The present invention is able to make logs of and to automatically feed financial stock signatures printed as closed head signatures that are difficult to align.

In addition to solving ergonomic problems, the building of a log, its transfer and an automatic jogging and alignment of signatures being fed into a graphic arts machine may result in increased production speed, particularly for long production runs for this invention. Also, this invention may result in crew reduction for the bindery line in some instances.

The preferred and illustrated embodiment of the invention comprises four major assembly components. They are 1) pocket load assembly, 2) signature transfer assembly, 3) the jogger assembly and 4) a programmable logic controller (PLC). Both the pocket load assembly and the signature transfer assembly are pivotally mounted on the frame. Initially the pocket load assembly is in a vertical position; while the signature transfer assembly is in an inclined horizontal position. The pocket load assembly includes sensing means associated with the drive system for a signature supporting plate, which is advantageously, adjustably positioned at a pre-selected signature loading height that may be reset for each individual operator at any position intermediate to the vertical upper limit and the vertical lower limit. The pocket load assembly is such as to cause the drive system to initially position the signature supporting plate at the pre-selected signature loading height to assist a particular operator in placing signatures thereon when the signature supporting plate is in the signature receiving position. Still additionally, the sensing means is operable to cause the drive system to lower the signature supporting plate in such a manner as to cause the top of the signatures placed thereon at any time by the operator to be maintained at the pre-selected signature loading height until such time as the signature supporting plate reaches the vertical lower limit.

Once the pocket load assembly is filled, the operator presses the pocket filled push button, which begins a series of automatic functions. These automatic functions are controlled by the programmable logic controller and the following sequence of events takes place automatically. The signature receiving assembly, which was heretofore in an inclined horizontal position drops down into a vertically inclined position. At that time, the pocket load assembly will lower to join with the signature receiving assembly, and thus, the two assemblies are in an inclined but aligned position. Next, the signatures which are in the pocket load assembly, are pushed forward so that they are entirely on the signature receiving assembly and then, the signature receiving assembly raises to the horizontally inclined position and in line with the jogger assembly. The pocket load assembly then returns to its vertical position; the receiving plate returns to its desired position as has been set by the operator; and the series of events will repeat after the operator loads the pocket load assembly and pushes the pocket filled push button. During this time, the previous load of signatures, which was placed into the signature receiving assembly, is slowly pushed forward into the jogger assembly as room is made by signatures being removed therefrom and into the saddle of the bindery line. While the signatures move forward toward the receiving pocket, they are in the jogger assembly; and as such, they are jogged, aerated with airflow and aligned so that they are perfectly straight and free to be gripped by the grippers of the bindery line hopper assembly.

Other objects, advantages and features of the present invention will become apparent from a consideration of the following specification taken in conjunction with the accompanying drawings.

DETAILED DESCRIPTION OF THE PREFERRED EMBODIMENT

In the illustrations given, and with reference first to FIGS. 1–12, the overall movement of signatures 240 and operation of the Automated Bindery Log Extension (referred to as the ABLE feeder from hereon), are depicted in a step by step manner. FIGS. 13–20 refer to more detailed operations and unique descriptions.

Figure 1:
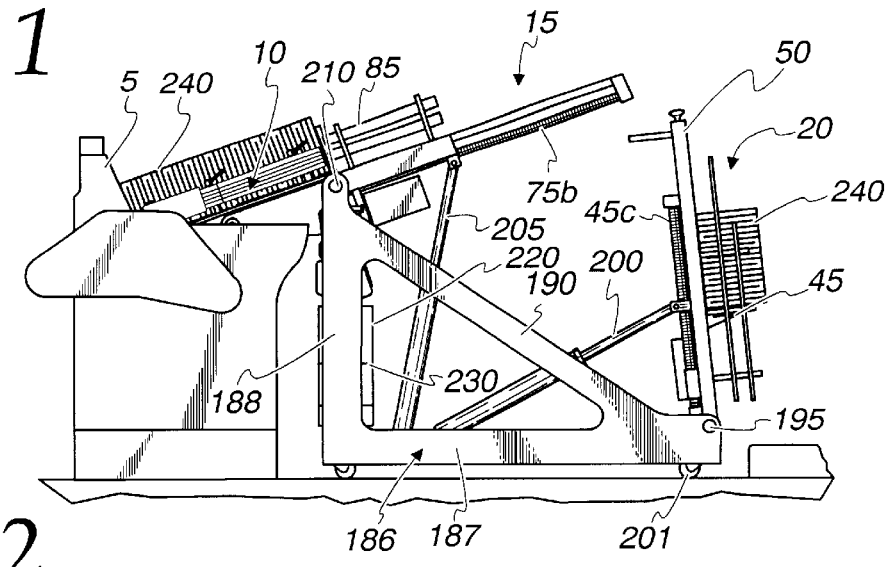
FIGS. 1–12 are a sequence of diagrammatic views showing the building of a log and feeding a bindery line pocket in accordance with a preferred embodiment of the present invention.
Figure 2:
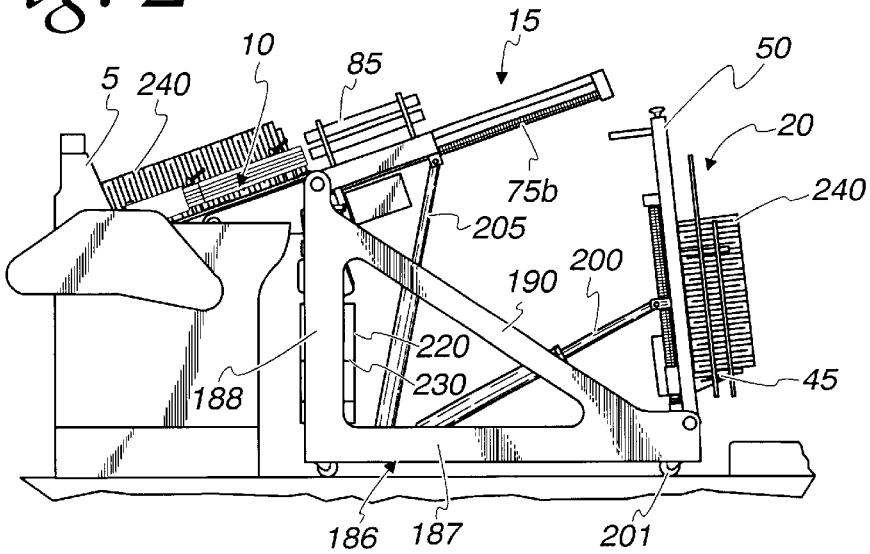
Figure 3:
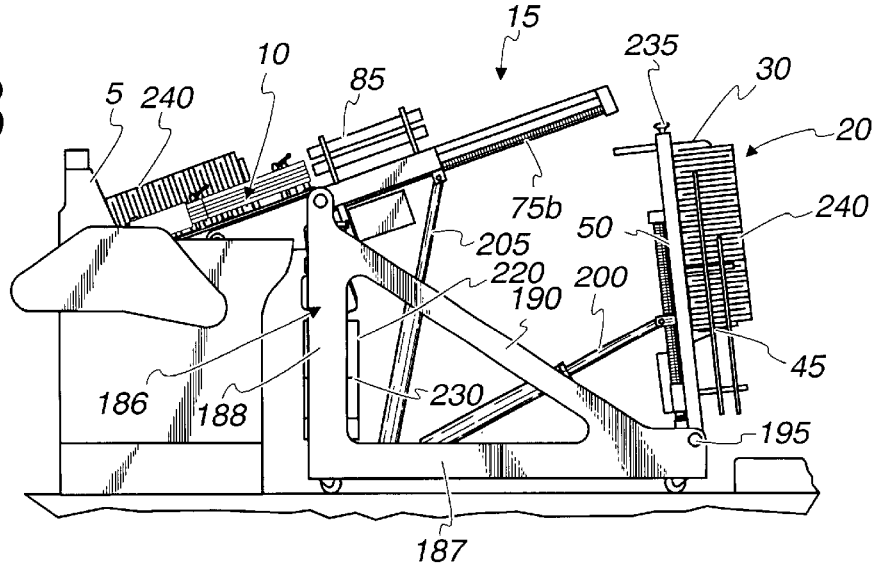

A brief, overall description of the illustrated apparatus will be given first. As best seen in FIGS. 1–3, signatures 240 are being loaded on a support seat 45 in a Pocket Load Assembly 20.

Figure 4:
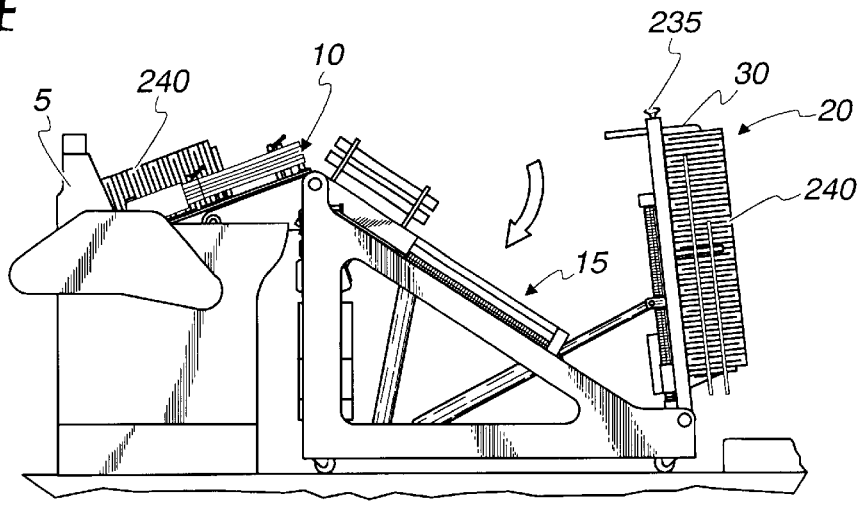
Figure 7:
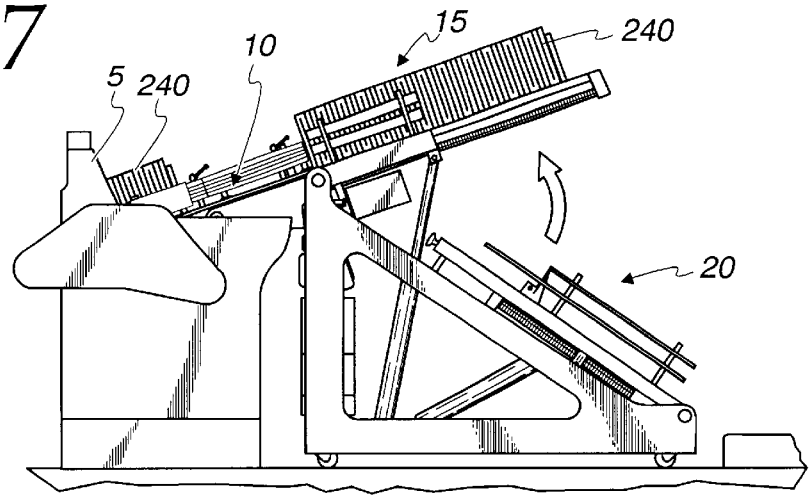
Figure 8:
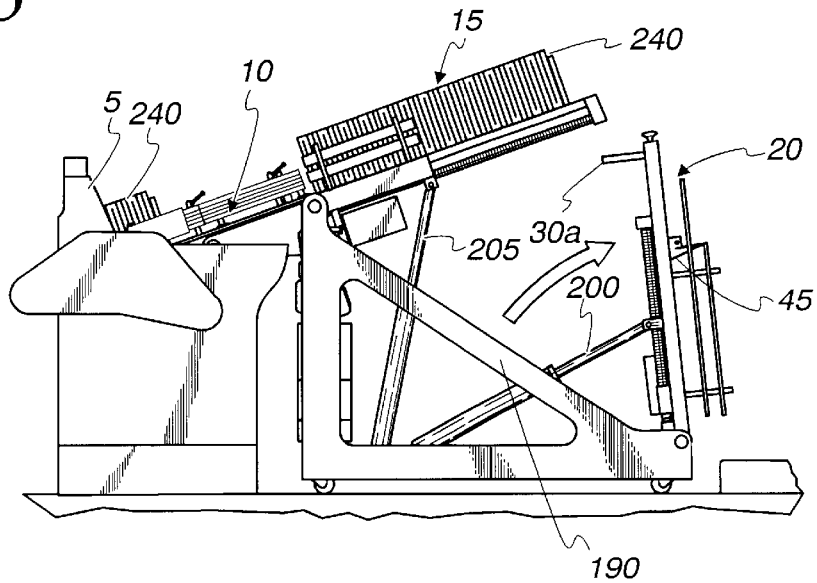
Figure 9:
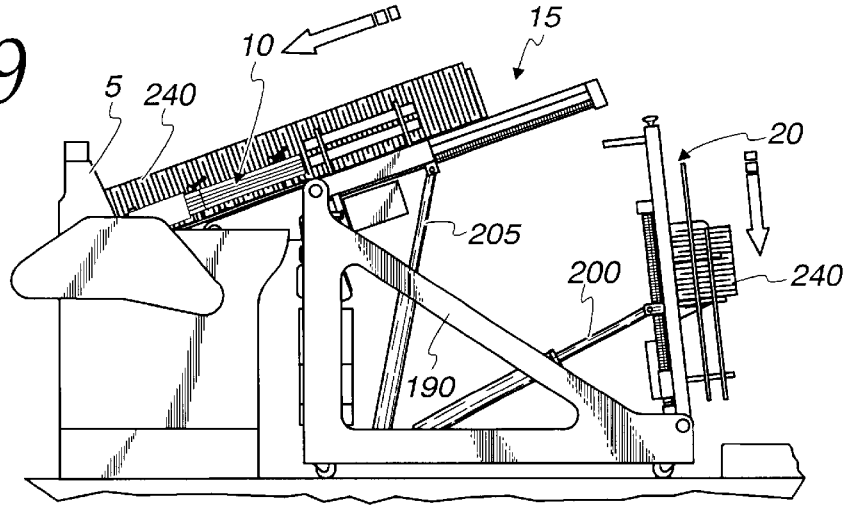
Figure 10:
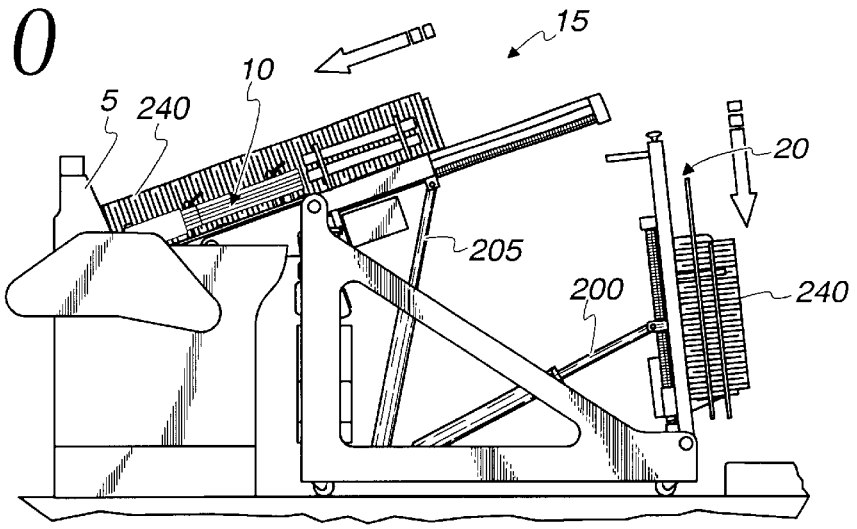
Figure 11:
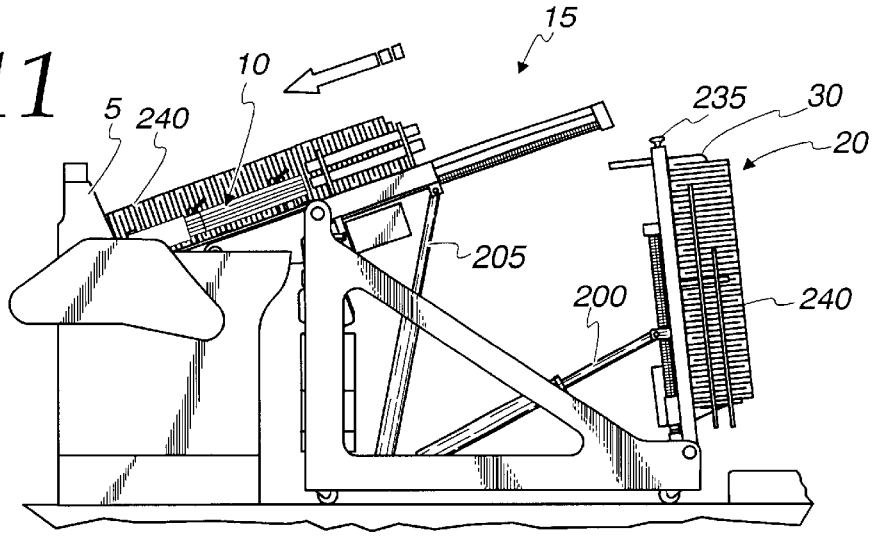
Figure 12:
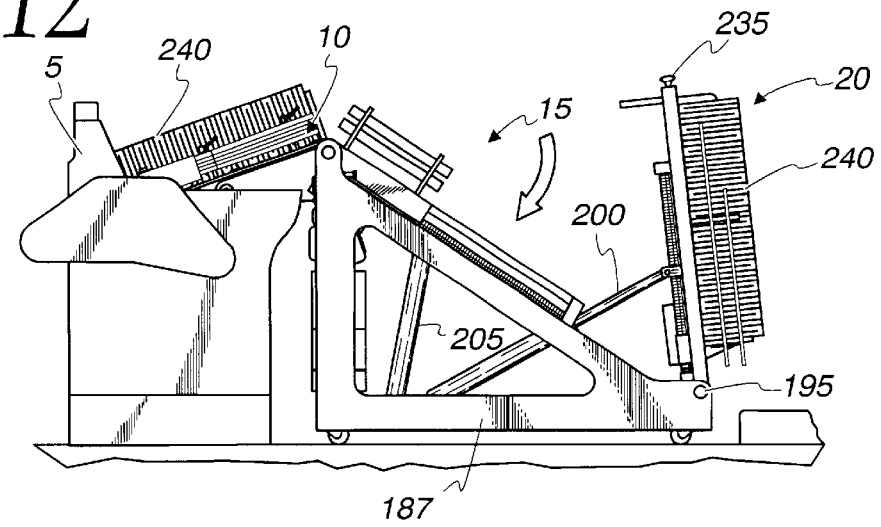
Figure 13:
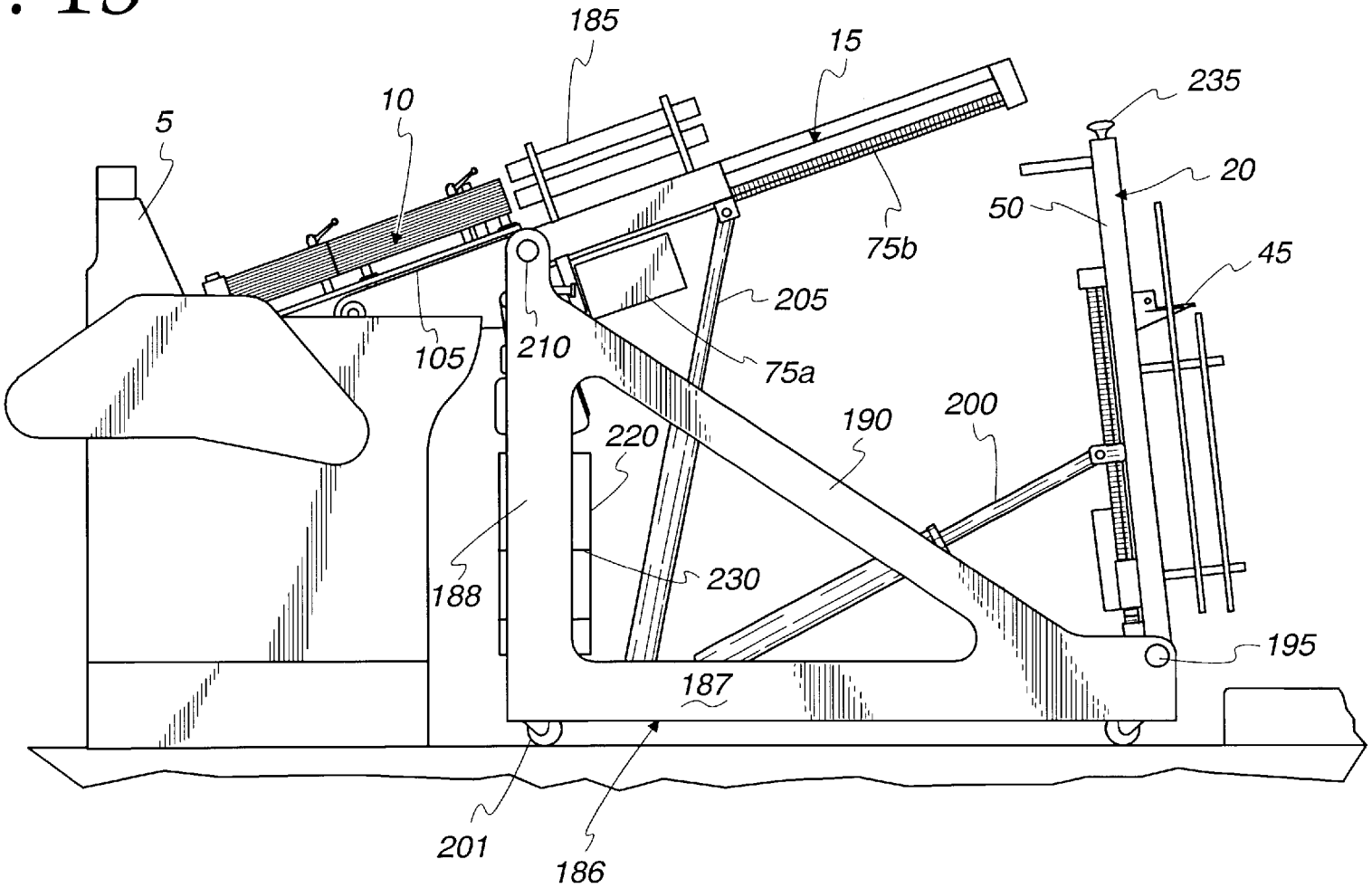
FIG. 13 is an assembly drawing showing all the major parts of the present invention.
Figure 14:
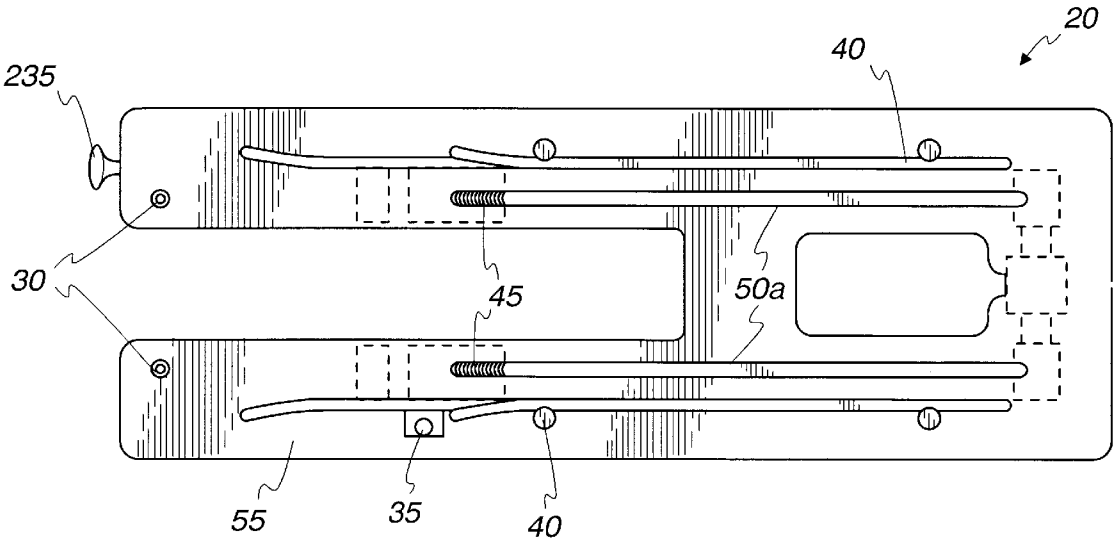
FIG. 14 is a top view of the pocket load assembly.
Figure 15:
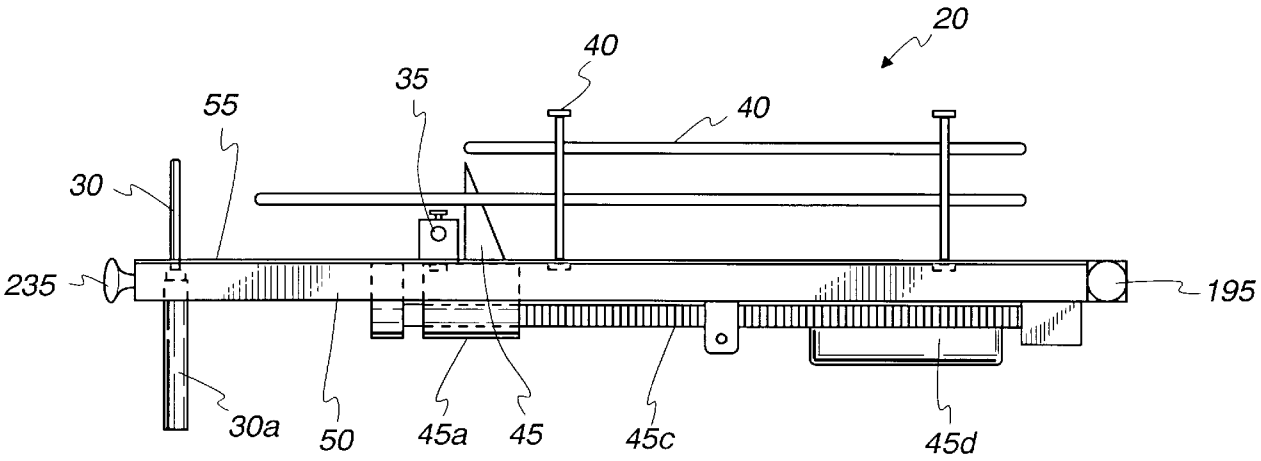
FIG. 15 is a side view of the pocket load assembly.
Figure 16:
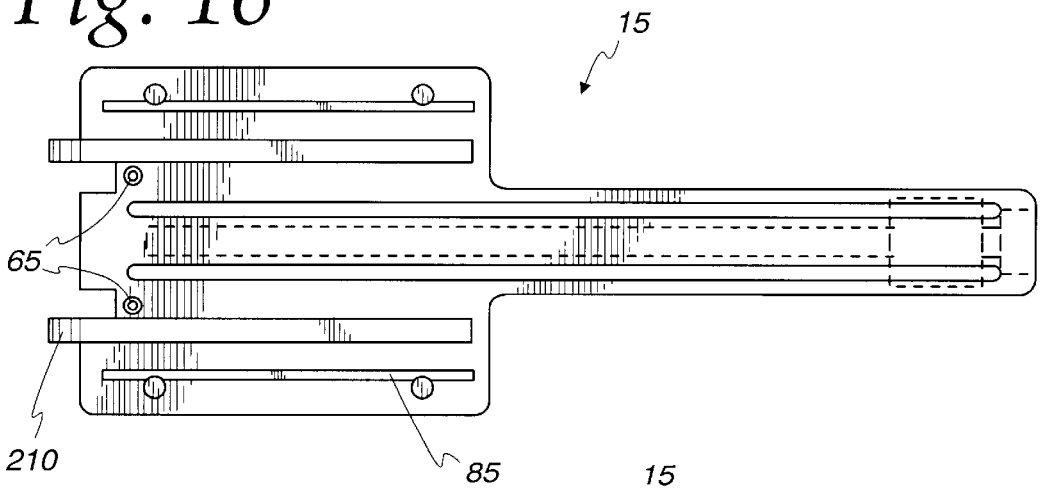
FIG. 16 is a top view of the signature transfer assembly.

The Pocket Load Assembly 20 is continually loaded with additional signatures 240; while the signatures 240 in the Jogger Assembly 10 continue to feed into the Host Bindery Pocket 5, in FIGS. 2 and 3, until the Pocket Load Assembly 20 is full. When the pocket load assembly is full, a timer or other automatic device can cause a transfer of the log. Herein, the operator causes the transfer when the operator presses the Pocket Filled Push Button 235, which begins a series of automatic steps controlled by a controller such as a PLC 230 which herein is mounted in an electrical control cabinet 220. In FIG. 4, the Signature Transfer Assembly 15 lowers to accept new signatures 240. Then, the Pocket Load Assembly 20 also lowers (FIG. 5) in alignment with the Signature Transfer Assembly 15. The signatures 240 are transferred (FIG. 6); and the Signature Transfer Assembly 15 raises up and back into alignment with the Jogger Assembly 15 (FIG. 7). Finally, the Pocket Load Assembly 20 raises the empty seat 45 back up in preparation to receive more signatures 240 from the operator (FIG. 8). During this entire automated process, the Jogger Assembly 10 has continued to feed signatures 240 to the Host Bindery Pocket 5. The final step occurs as the signatures 240, which have just been transferred to the Signature Transfer Assembly 15, are moved forward in the Jogger Assembly 10 (FIG. 9). Then, the entire procedure begins again, as shown in FIGS. 10–12.

Figure 18:
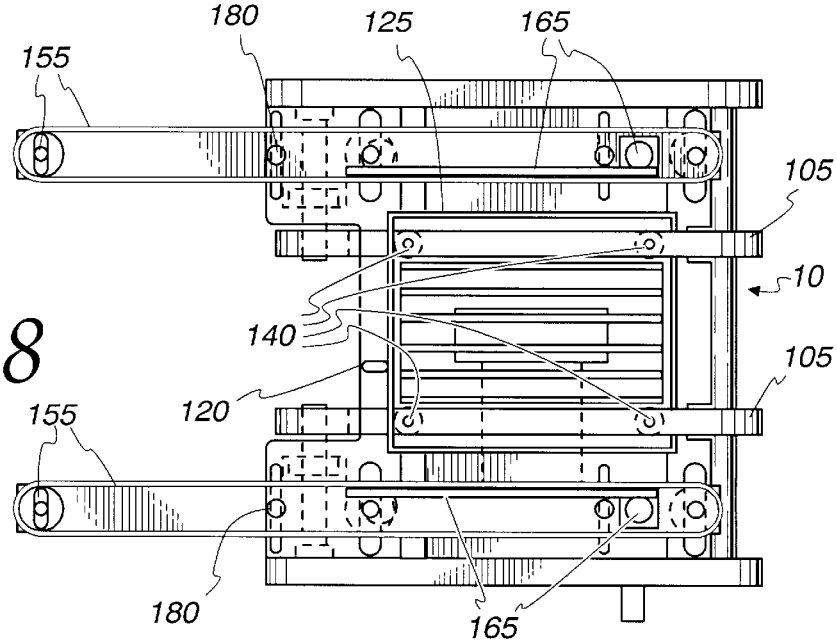
FIG. 18 is a top view of the jogger assembly.
Figure 19:
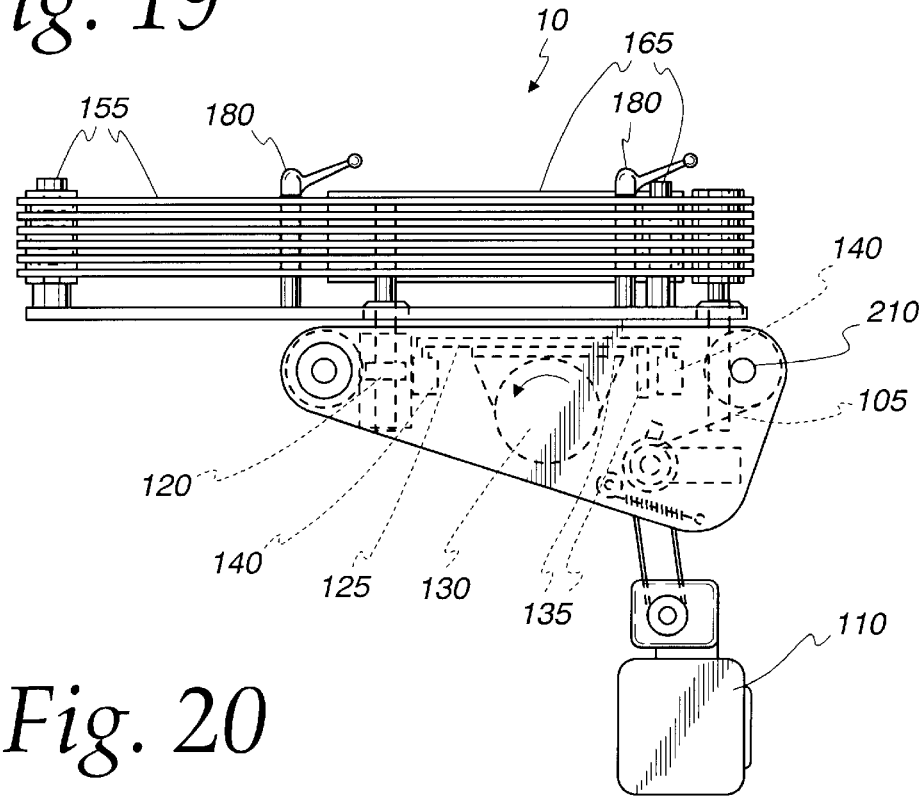
FIG. 19 is a side view of the jogger assembly.
Figure 20:
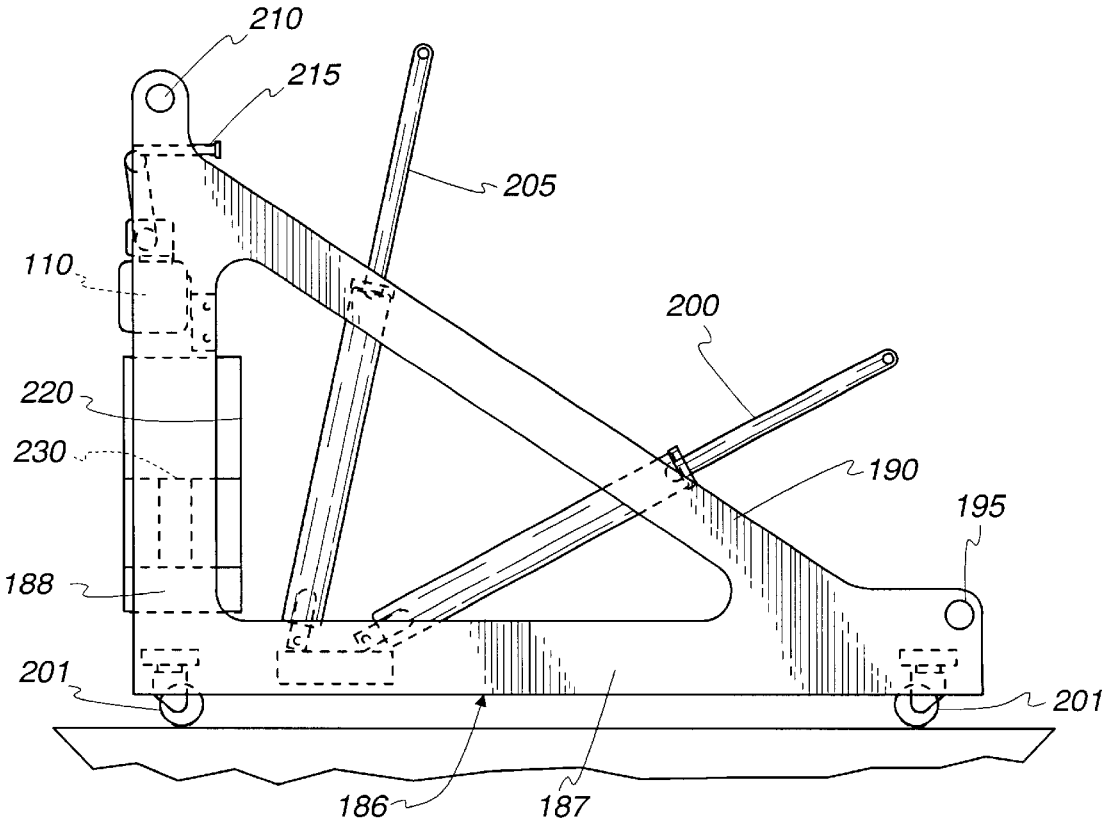
FIG. 20 is a side view of the frame and attachments, including the programmable logic controller (PLC).

A more detailed discussion involving FIGS. 13–20 follows. The ABLE feeder is designed to be rolled on wheels 201 (FIG. 20) to and fit into a bindery feed pocket, and aligned with the pocket feed chains. The ABLE feeder comprises a main frame 186 having lower horizontal bottom frame members 187, upstanding leg frame members 188, and inclined side frame members 190. Alignment of Jogger Assembly 10 is accomplished by turning the adjustment screw 215, clockwise or counterclockwise, as needed, which is shown in FIG. 20. Utilities for the ABLE are then connected with a pneumatic quick connect fitting and an electrical plug. Activation of the utilities positions both the Pocket Load Assembly 20 and the Signature Transfer Assembly 15 into their upright positions.

The set-up of the ABLE feeder is accomplished by adjusting the pocket load assembly, adjustable slide guides 40 and the Signature Transfer Assembly side guide brushes 85 to the width of the signatures 240. Additionally, the operator can position the adjustable, high proximity sensor 35 (FIG. 14) to adjust the surface height of the linear motion pocket seat assembly 45.

Initial loading of the ABLE feeder requires manual loading of the bindery host pocket 5; and the jogger assembly 10 of the ABLE feeder. Thereafter, piles or lifts of signatures 240 are taken from a pallet by the operator and are loaded in the Pocket Load Assembly 20 and placed between the adjustable side guides 40, and on top of the linear motion seat 45. Rather than lifting only 3–4" piles from the pallet, and rotating and fanning this small pile of signatures 240 herein, the operator merely places his fingers under a larger 8" pile and sets them down onto the previous signatures 240 on the seat 45 without any rotation and at a comfortable height for the operator. This should result in better production for the bindery, particularly for long runs where operator fatigue could be a limiting factor on the production rate of the bindery line. Herein, the seat assembly comprises the seat 45, which is a platform, or support, having an underlying nut 45*a* (FIG. 15) through which extends a longitudinal drive screw 45*c*, which is rotated by a screw drive motor 45*d*. The screw drive motor 45*d* is reversible to rotate the screw in opposite directions to either raise or lower the seat 45. The seat 45 travels within a pair of slots 50*a* (FIG. 14) in supporting frame plate 55 to which are secured longitudinal frame bars 50. The frame bars 50 are pivotally mounted at their lower end by pivot pin assemblies 195 to the bottom frame member 187.

Placement of the signatures 240 on the seat 45 initiates the adjustable height proximity sensor 35 starting a delay timer in the Programmable Logic Controller (PLC) 230. The delay timer permits the time required to properly load the signatures 240 without the movement of the linear motion pocket seat 45. When the delay timer times out, the linear motion pocket seat 45 repositions itself lower to permit the next lift of signatures 240 to be placed at the same height as the previous lift, which is typically 8" for this illustrated apparatus. This process continues until the Pocket Load Assembly 20 is filled; and the operator presses the Pocket Filled Push Button 235. Pressing of the Pocket Filled Push Button 235 begins a series of automatic functions.

Figure 17:
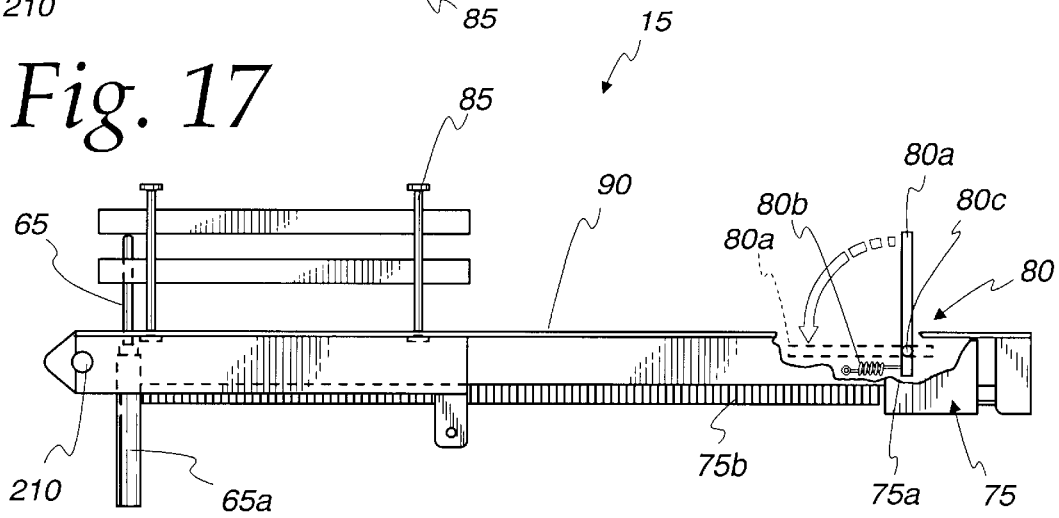
FIG. 17 is a side view of the signature transfer assembly.

In the Pocket Load Assembly 20, the stopping pins air cylinders 30*a* (FIGS. 4 and 15) are activated, placing the stop pins 30 in their upright position. Then, the linear motion pocket seat 45 is repositioned, placing the loaded signatures 240 tight against the air cylinder stop pins 30 to hold tightly the log and its upper signatures 240 in place when the pocket load assembly is pivoted. This is the "ready" position for the Pocket Load Assembly. The Programmable Logic Controller (PLC) 230 then examines the position of the linear motion transfer drive 80 (FIG. 17). If the drive location is in the closest position to the Jogger Assembly 10, as shown in FIG. 2, this indicates that the Signature Transfer Assembly 15 is empty of signatures 240 and is ready to accept a new log from the pocket load assembly 20. The PLC 230 actuates the Signature Transfer Assembly position air cylinder 205 (FIG. 20), rotating the Signature Transfer Assembly 15 clockwise towards the Pocket Load Assembly 20. At the end of the Signature Transfer Assembly position air cylinders 205 stroke, the PLC 230 actuates the Pocket Load Assembly position air cylinder 200 rotating the Pocket Load Assembly 20 counterclockwise towards the Signature Transfer Assembly 15, as between the upright position of FIG. 4 and the lowered, inclined position of FIG. 5.

Figure 5:
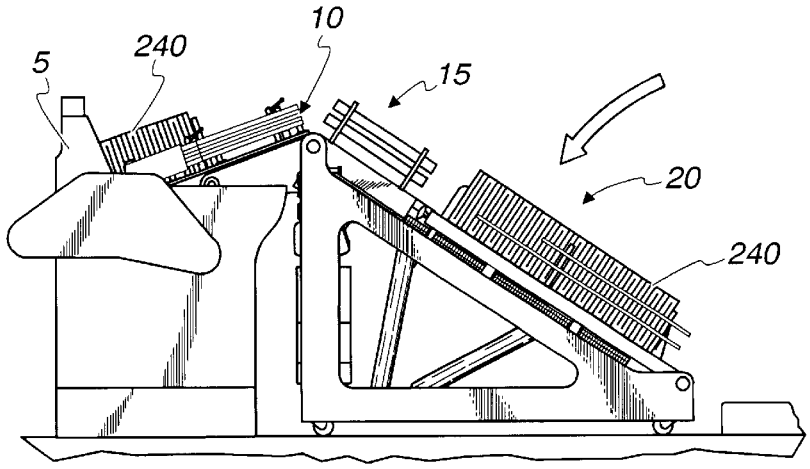
Figure 6:
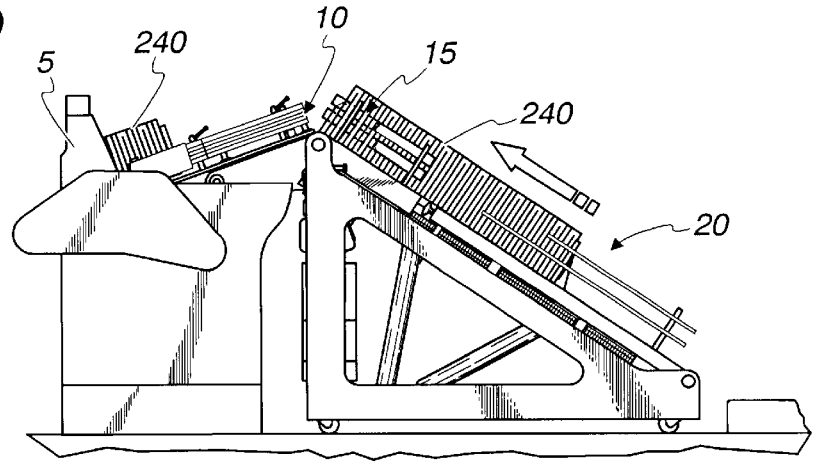

At the end of the Pocket Load Assembly Air Cylinder stroke, the following sequence of events takes place automatically controlled by the PLC 230:

1) the Pocket Load Assembly Air Cylinder pins 30 are retracted by air cylinders 30*a;*
2) the Pocket Load Assembly Linear Motion Seat 45 raises to its highest position (FIG. 8);
3) the Signature Transfer Assembly Linear Motion Transfer Drive 75 herein comprised of a nut 75*a* and a feed screw 75*b* (FIG. 17) of the Transfer Load Assembly 15 travels to its lowest point. As the Pivoting Pin Assembly 80 comes in contact with the signatures 240 from the Pocket Load Assembly 20, the spring biased pins 80*a* are pivoted away from and under the signature log. As the Linear Motion Transfer Drive 75 and pivoting lower pins 80 complete their travel under the signatures 240, a loaded spring 80*b* rotates the pivoting pins 80*a* about pivot pins 80*c* back to their upright position;
4) the Signature Transfer Assembly Air Cylinder Stop Pins cylinders 65*a* (FIG. 17) are activated, placing the upper pins 65 in their upright position;
5) the Signature Transfer Assembly Linear Motion Transfer Drive 75 comprises a reversible, electric motor nut 75*a* (FIG. 17) for linear travel along a threaded drive screw 75*b*, mounted beneath a frame 90 for the transfer assembly. The spring 80*b* has one end mounted on the nut 75*a* and the other end is secured to the pivoted pin 80*a* to pivot the pin upright about the pivot pin 80*c*, which is mounted on the nut 75*a*. Having received a log of signatures 240, as the Pocket Load Assembly 20 is pivoted down from its upright position of FIG. 4, to a position overlying the Transfer Assembly 15, as shown in FIG. 5, the log is then captured and gripped between the upper pins 65 and lower pins 80*a* on the Transfer Assembly 15. To this end, the transfer drive 75 then is activated to traverse the lower pins up the incline to push the upper end of the log into contact with the upper, air cylinder stop pins 65;
6) the Signature Transfer Assembly Position Air Cylinder 205 (FIG. 20) is actuated and the Signature Transfer Assembly 15 is rotated counterclockwise from its lowered position of FIG. 6 to its upright position of FIG. 7 pivoting about its pivot pin assembly 210 at the top end of the upstanding frame member 188;
7) the formerly upper and now forward pins 65 of the Signature Transfer Assembly Air Cylinder Stop Pin Assembly are now retracted, and the Linear Motion Transfer Drive 75 (FIG. 17) travels the pins 80 forwardly thereby forward feeding signatures 240 into the Jogger Assembly 10;
8) the Pocket Load Assembly Position Air Cylinder 200 is actuated and rotates the Pocket Load Assembly 20 back to its upright position of FIG. 8, ready to accept lifts of new signatures 240.

This procedure of loading and transferring signatures 240 from the Pocket Load Assembly to the Jogger Assembly continues through the length of the production run.

Referring to FIGS. 18 and 19, the Jogger Assembly 10 will now be discussed in combination with the host bindery pocket 5.

The host bindery pocket 5 continues its normal practice of advancing signatures 240 on a set of feed chains or belts actuated by a mechanical clutch, and then pulling the signatures 240 into the main drum grippers with suction cups. As the feed chains or belts index forward, a proximity switch speed sensor 120 (FIG. 18) reads the speed of the chains or belts of the host bindery pocket 5 and sends a signal to the PLC 230. The PLC 230 then outputs a signal for the Jogger Assembly drive motor 110 (FIG. 19) to index forward as well as the signature Transfer Assembly Linear Motion Transfer Drive 75, to maintain a steady and continuous stream of signatures 240 into the Jogger Assembly 10 and the host bindery pocket 5.

It will be recalled from the earlier description of the motions by the operator that the operator fanned and jogged the signatures 240 manually to separate the signatures 240 for easy gripping by the host bindery pocket 5, and the operator aligned the signatures 240 head-to-foot so that they also were properly positioned for the grippers of the host bindery pocket 5. In this embodiment, the backbone, or spine, of the signatures 240 is down resting an underlying platen 125 (FIG. 18), which is generally a horizontal, flat, slotted plate that underlies and supports the signature spines as they are pushed along the platen. Four rubber mounts 140 are positioned at the four corners of the platen 125 and support it for vibration by the rotary vibrator mechanism 130. Herein, the platen is jogged by the rotary vibrator mechanism 130 (FIG. 19) positioned beneath the platen and connected thereto to vibrate the platen and signature spines. Also, simultaneously aerating nozzles 135 (FIG. 19) emit streams of air through the slots in the platen to aerate the upright signatures 240 to assist in their repositioning and alignment. The head and foot of the signatures 240 are being pushed by side joggers 165 to align the heads of signatures 240 on one vertical side, and to align the foot of the signatures 240 on the other vertical side of the signatures 240. The aeration also assists in this head-to-foot jogging and alignment.

Referring now in greater detail to FIGS. 18 and 19, the signatures 240 are pushed into the Jogger Assembly 10 with the Linear Motion Transfer Drive 75, and they transition from the Signature Transfer Assembly tabletop 90 to the product transfer belts 105 (FIGS. 13 and 18) and between the set of side Jogger Belt Assemblies 155, which are adjusted against the signatures 240 with the side jogger adjustment handles 180. As the signatures 240 are indexed forward with the product transfer belts 105 and the side jogger belt assemblies 155, they pass between the oscillating side joggers 165, which align the signatures 240 head-to-foot. At the same time, the signatures 240 pass over the jogging platen 125, which simultaneously aerates the signatures 240 with the aerating nozzles 135 and aligns the signatures 240 spine-to-face with the rotary vibrator 130. It should also be noted that the speed and force of the rotary vibrator 130 and the oscillating side joggers 165 are fully adjustable for varying products, as is the air pressure of the aerating nozzles 135.

The signatures 240 now advance over the end of the product transfer belts 105 and onto the host bindery pocket feed chains, or belts. However, the side jogger belt assemblies 155 are extended, as best seen in FIG. 18, to continue to support and advance the signatures 240 into the host bindery pocket 5. Due to the extended length of the side jogger belt assemblies 155, the host bindery pocket side guides are not used and should be set to their widest setting or removed. The support and controlled advancement of the signatures 240 in the side jogger belt assemblies 155 is maintained until approximately 4" from the host pocket feed plate, at which time the signatures 240 are released from the side jogger belt assemblies 155 and fed into the host bindery pocket 5 as would be in normal practice.

While in the foregoing, there have been set forth preferred embodiments of the invention, it will be appreciated by those skilled in the art that the details herein given may be varied without departing from the true spirit and scope of the appended claims.

What is claimed is:

1. An automated pocket feeder apparatus for aligning, fanning, jogging and feeding signatures to an infeeder of a graphic arts machine, the apparatus comprising:

a pocket load device to receive stacks of signatures therein;

a vertically movable, support in the pocket load device being adjustable in height to allow a subsequent stack of signatures to be placed at substantially the same height as a previously placed stack of signatures to form a load of signatures;

a transfer device for transferring the load of signatures from the pocket load device;

an aligning and fanning device for receiving a load of signatures, and fanning and aligning the signatures, and feeding the aligned signatures into the graphic arts machine.

2. An automated pocket feeder apparatus in accordance with claim 1 wherein the infeeder has a pocket, the aligning and fanning device comprises oscillating side joggers which align the signatures therein head-to-foot.

3. An automated pocket feeder apparatus in accordance with claim 2 wherein:

the pocket has signature feed endless bands; and the side joggers extend into the pocket and jog the signatures while they are on the signature feed endless bands of the pocket.

4. An automated pocket feeder apparatus in accordance with claim 1 wherein an aerator aerates the signatures being jogged in the aligning and fanning device.

5. An automated, pocket feeder apparatus in accordance with claim 4 wherein a rotary vibrator assists in jogging and aligning the signatures traveling through the aligning and fanning device.

6. An ergonomic method of providing aligned and fanned signatures to an infeeder of a graphic arts machine, the method comprising:

filling signatures in stacks into a load-forming assembly and supporting the signatures to form a load of signatures;

automatically transferring the load of signatures from the load-forming assembly into an aligning and fanning assembly;

automatically aligning and fanning the load of signatures in the aligning and fanning assembly to form aligned and fanned signatures; and feeding the load of aligned and fanned signatures to an infeeder of the graphic arts machine.

7. An ergonomic method in accordance with claim 6, including automatically lowering a support for receiving the signatures to keep a constant height for a person to fill the load-forming assembly.

8. An ergonomic method in accordance with claim 6, including:

timing a predetermined period; and lowering a support for supporting the signatures in a timed relationship to keep the constant height for filling.

9. An ergonomic method in accordance with claim 6 including pivoting the stack of signatures on the load-forming assembly to overlie a transfer assembly with the load of signatures at a transfer position.

10. An ergonomic method in accordance with claim 9 including pivoting the transfer assembly and the transferred load of signatures from the transfer position to a feed deliver position and feeding the load of signatures into an aligning and fanning device for aligning and fanning the signatures.

11. An ergonomic method in accordance with claim 10 including capturing the load of signatures on the transfer assembly to hold the same against shifting, while the transfer assembly is pivoting to the feed-delivery position.

12. An ergonomic method in accordance with claim 10, including:

pivoting downwardly the transfer assembly from the feed-delivery position down to a lower, inclined transfer position;

pivoting the load-forming assembly down to an inclined transfer position overlying the transfer assembly.

13. An ergonomic method in accordance with claim 12 including returning the support of the load-forming assembly to an upper position to receive the first stack of the next load of signatures.

14. An ergonomic method in accordance with claim 6, including:

setting of the height of the support platform by the user to the desired height for filling; and setting of a time interval period by the user for automatically lowering the support for the next stack of signatures.

15. An ergonomic method in accordance with claim 6, including:

aerating the signatures;

jogging the signatures; and vibrating the signatures to align and fan the signatures in the aligning and fanning device.

16. An ergonomic method in accordance with claim 6 including oscillating side joggers in the aligning and fanning assembly to align the signatures head-to-foot.

17. An ergonomic method in accordance with claim 16 including aerating the signatures as they are being jogged.

18. An ergonomic method in accordance with claim 16 including vibrating the signatures with a vibrating device in the aligning and fanning assembly.

19. An ergonomic apparatus for providing aligned and fanned signatures to a feed pocket of a bindery line, the apparatus comprising:

a load-forming assembly having a support for holding signatures loaded onto the support;

a transfer assembly for automatically transferring the load of signatures from the load-forming assembly;

an aligning and fanning assembly for receiving the transferred signatures and for automatically aligning and fanning the load of signatures while in the aligning and fanning assembly; and a feeder for the aligned and fanned signatures to the feed pocket of the bindery line.

20. An ergonomic apparatus in accordance with claim 19, including a device for automatically lowering the support for receiving the signatures to keep a constant height for a person to fill the load-forming assembly.

21. An ergonomic apparatus in accordance with claim 19, including a timer for a predetermined period and for operating the lowering device for the support to lower the support in a timed relationship to keep the constant height for filling.

22. An ergonomic apparatus in accordance with claim 19 including a pivot assembly for the load-forming assembly for pivoting the stack of signatures on the load-forming assembly to overlie the transfer assembly at a transfer position.

23. An ergonomic apparatus in accordance with claim 22 including a pivot assembly for the transfer assembly for pivoting the transferred load of signatures from the transfer position to a feed deliver position for feeding the load of signatures into an aligning and fanning assembly for aligning and fanning the signatures.

24. An ergonomic apparatus in accordance with claim 23 including retractable members for capturing the load of signatures on the transfer assembly to hold the same against shifting, while the transfer assembly is pivoting to the feed-delivery position.

25. An ergonomic apparatus in accordance with claim 23, including a supporting frame for supporting the load deliver assembly at an inclined transfer position overlying the transfer assembly.

26. An ergonomic apparatus in accordance with claim 19, including:

a device for setting of the height of the support platform by the user to the desired height for filling; and a device for setting of a time interval period by the user for automatically lowering the support for the next stack of signatures.

27. An ergonomic apparatus in accordance with claim 19 including oscillating side joggers in the aligning and fanning assembly for shifting the signatures to align the signatures head-to-foot.

28. An ergonomic apparatus in accordance with claim 27 including an aerator for aerating the signatures as they are being jogged.

29. An ergonomic apparatus in accordance with claim 27 including a vibrator for vibrating the signatures in the aligning and fanning assembly.

30. An ergonomic bindery apparatus, comprising:

an angularly-disposed first section having a first signature outlet end and a first signature inlet end;

a pivotally-mounted, second section adjacent said first section having a second signature inlet end and a second signature outlet end aligned with said first signature inlet end and being pivotal between a downward signature loading position and an upward position planar with said first section;

a pivotally-mounted, third section adjacent said second section having a third signature outlet end, third signature inlet end and being pivotal between an upward signature loading position and a downward position planar with the downward position of said second section and having said third signature outlet end aligned with said second signature inlet end when both said third section and said second section are in their downward position.

31. An ergonomic bindery apparatus, comprising:

an angularly-disposed first section having a first signature outlet end and a first signature inlet end;

a pivotally-mounted, second section adjacent said first section having a second signature inlet end and a second signature outlet end aligned with said first signature inlet end and being pivotal between a downward signature loading position and an upward position planar with said first section;

a pivotally-mounted, third section adjacent said second section having a third signature outlet end and a third signature inlet end and being pivotal between an upward signature loading position and a downward position planar with the downward position of said second section and having said third signature outlet end aligned with said second signature inlet end when both said third section and said second section are in their downward position; and a programmable logic controller for controlling the pivoting operations and timing.

32. An ergonomic bindery apparatus in accordance with claim 31, including swivel wheel casters for portability to and from a bindery feed pocket.

* * * * *